US006688893B1

(12) United States Patent
Huang et al.

(10) Patent No.: US 6,688,893 B1
(45) Date of Patent: Feb. 10, 2004

(54) ELECTRICAL CONNECTOR HAVING HIGH PERFORMANCE CONTACTS

(75) Inventors: Chieh-Rung Huang, Tu-Chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/443,598

(22) Filed: May 21, 2003

(30) Foreign Application Priority Data

Nov. 13, 2002 (TW) ..... 91218161 U

(51) Int. Cl.[7] ..... H01R 12/00
(52) U.S. Cl. ..... 439/66; 439/862
(58) Field of Search ..... 439/66, 65, 862, 439/733.1, 71, 83

(56) References Cited

U.S. PATENT DOCUMENTS 6,210,176 B1 4/2001 Hsiao
6,305,948 B1 * 10/2001 Wu ..... 439/66
6,464,512 B2 * 10/2002 Morita ..... 439/66

* cited by examiner

*Primary Examiner*—Tho D. Ta
(74) *Attorney, Agent, or Firm*—Wei Te Chung

(57) ABSTRACT

An electrical connector (1) includes an insulative housing (10) having a first surface (101) and a second surface (102). The housing defines a plurality of passageways (103) communicating the first surface and the second surface, each passageway receiving two opposite contacts (12) therein. Each contact defines a base portion (121) interferentially received in the housing, a solder portion (122) extending from an end of the base portion, a bending portion (123) extending from the other end of the base portion and an elastic portion (124) extending from the distal end of the bending portion. In addition, the elastic portion defines a contacting pad (1241), which is used to electrically connect with an LGA IC module. An area of the contacting pad is less than an area of the solder portion, and a vertical projection of the contacting pad on the solder portion is entirely within the solder portion.

8 Claims, 5 Drawing Sheets

ELECTRICAL CONNECTOR HAVING HIGH PERFORMANCE CONTACTS

BACKGROUND OF THE INVENTION

1. Field of the Invention

The present invention relates to an electrical connector used for electrically connecting a land grid array (LGA) integrated circuit (IC) module to a printed circuit board (PCB).

2. Description of the Prior Art

The size of electrical connectors used in computers is becoming steadily smaller. Such connectors essentially comprise a housing and a plurality of contacts received in the housing. Yet the contacts of the connector need to have long elastically deformable arms, in order to ensure reliable electrical connection between the connector and an electrical package mounted on the connector.

A typical such connector is disclosed in Taiwan Patent Publication No. 444960. Referring to FIGS. 6 and 7, the connector comprises a base 8 defining a plurality of passageways 80 adapted to receive corresponding contacts (not shown). Each row of passageways 80 defines a line forming an angle of 45 degrees relative to a sidewall 82 of the connector. This configuration provides each passageway 80 with sufficient space to receive a contact having long elastic arms. However, when installing the contacts into the passageways 80, a contact carrier strip (not shown) should also form an angle of 45 degrees relative to the sidewall 82 in order to install the contacts into the passageways row by row. Rows of the passageways respectively forming an angle of 45 degrees relative to the sidewall have varying numbers of passageways therein. Thus a plurality of carrier strips of varying lengths must be used to install the contacts into the passageways. This is unduly difficult and costly.

Hence, a new electrical connector is desired to overcome the above-described disadvantages.

SUMMARY OF THE INVENTION

An object of the present invention is to provide an electrical connector which has high performance contacts and which is readily assembled.

In order to achieve the aforementioned object, an electrical connector in accordance with a preferred embodiment of the present invention comprises an insulative housing having a first surface and a second surface. The housing defines a plurality of passageways communicating the first surface and the second surface, each passageway receiving two opposite contacts therein. Each contact defines a base portion interferentially received in the housing, a solder portion extending from an end of the base portion, a bending portion extending from the other end of the base portion and an elastic portion extending from the distal end of the bending portion. In addition, the elastic portion defines a contacting pad, which is used to electrically connect with an LGA IC module. An area of the contacting pad is less than an area of the solder portion, and a vertical projection of the contacting pad on the solder portion is entirely within the solder portion.

Other objects, advantages and novel features of the present invention will become more apparent from the following detailed description when taken in conjunction with the accompanying drawings.

DESCRIPTION OF THE PREFERRED EMBODIMENT

Figure 1:
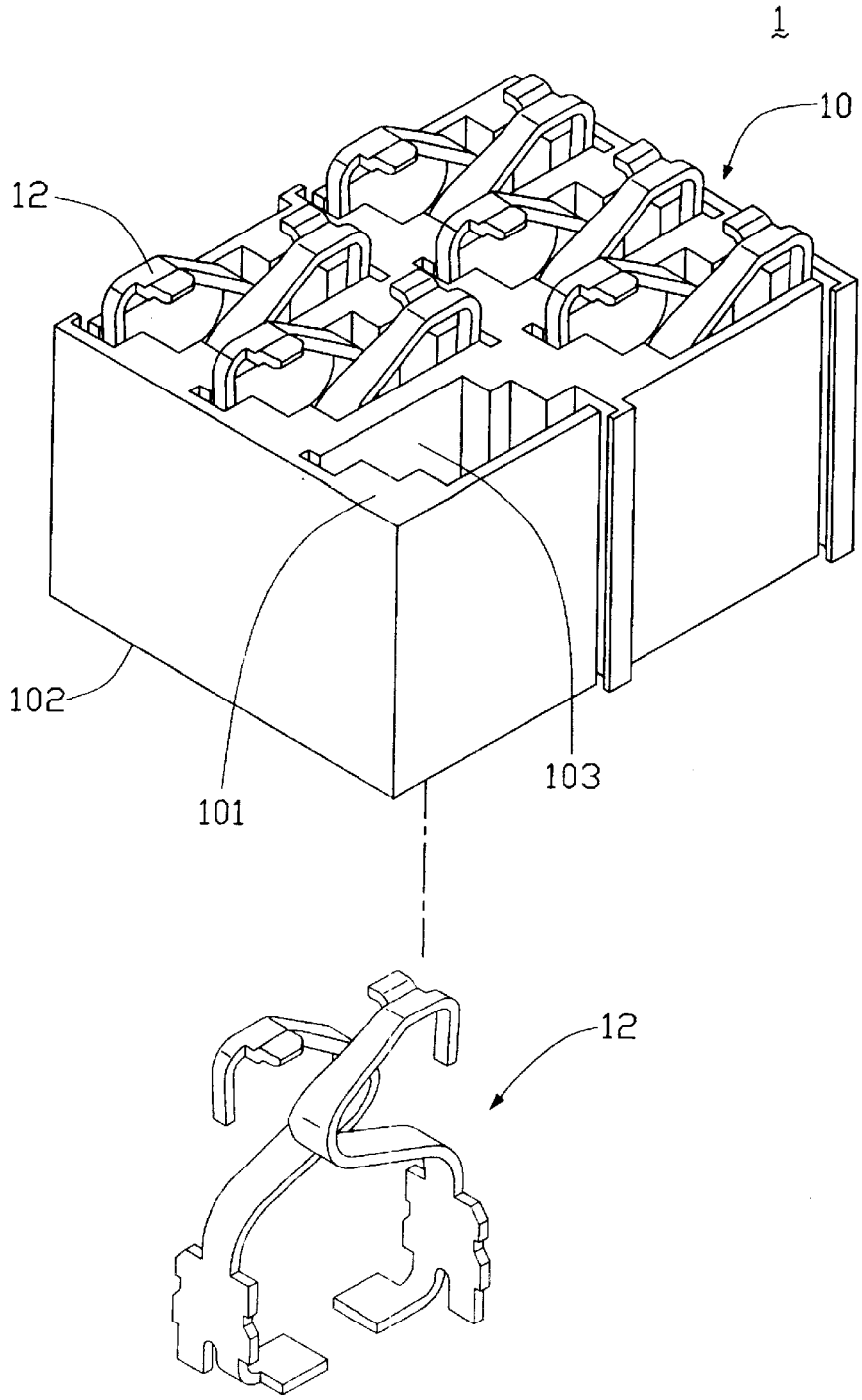
FIG. 1 is an exploded, isometric view of an electrical connector in accordance with the preferred embodiment of the present invention.

Reference will now be made to the drawing figures to describe the present invention in detail.

Figure 2:
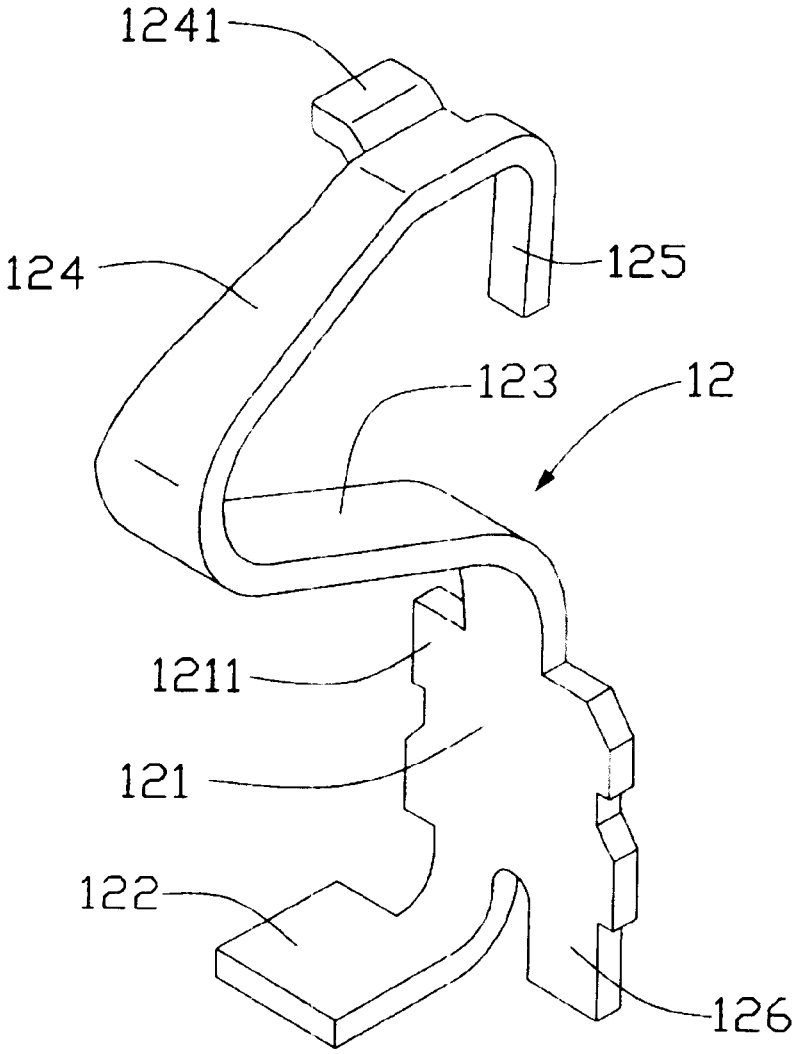
FIG. 2 is an enlarged view of one contact of the electrical connector of FIG. 1.
Figure 3:
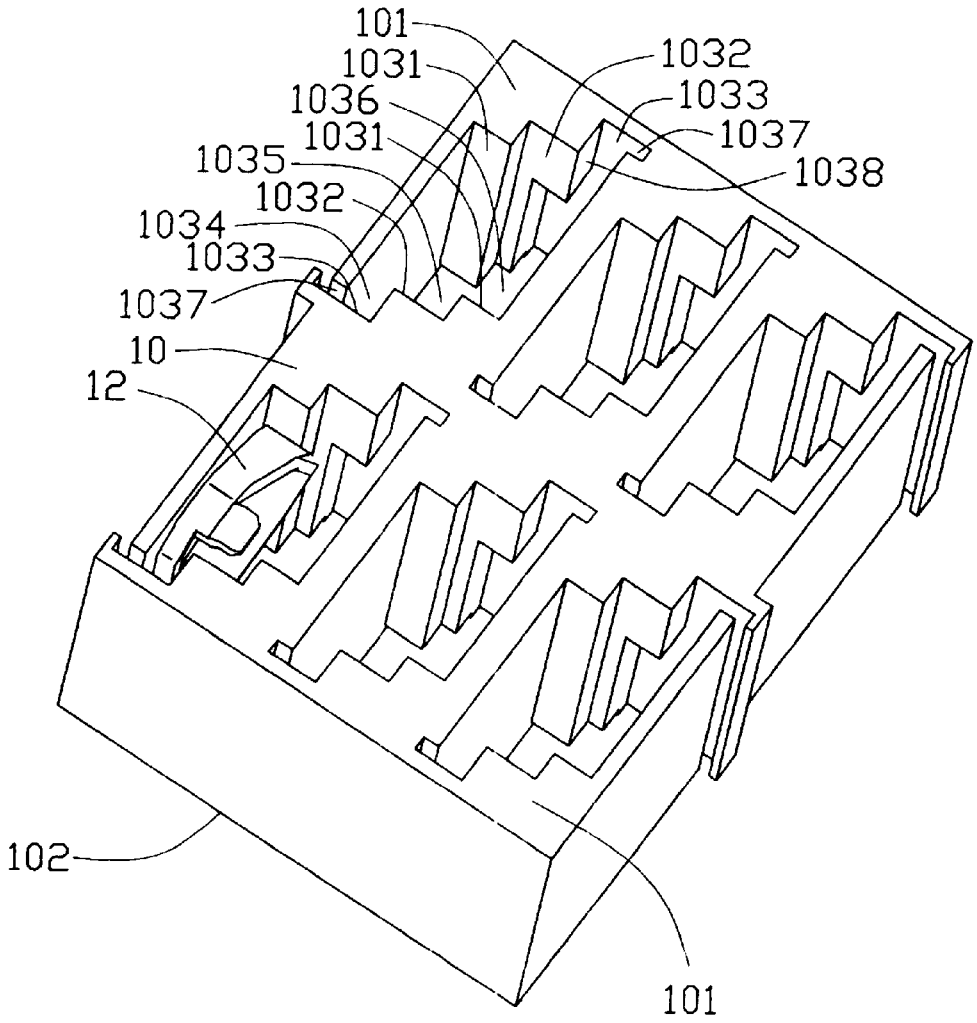
FIG. 3 is an isometric view of a housing of the electrical connector of FIG. 1, with one contact installed therein.

Referring to FIGS. 1–3, an electrical connector 1 is used for electrically connecting an LGA IC module (not shown) to a PCB (not shown). The connector 1 comprises an insulative housing 10 defining a first surface 101, an opposite second surface 102, and a plurality of passageways 103 communicating therebetween. Each passageway 103 receives two same contacts 12 therein.

Each contact 12 comprises a base portion 121 interferentially received in a corresponding passageway 103, a solder portion 122 extending from a bottom end of the base portion 121, a bending portion 123 extending from an opposite top end of the base portion 121, an elastic portion 124 extending from a distal end of the bending portion 123, and a guiding portion 125 extending from a distal end of the elastic portion 124. The elastic portion 124 and the bending portion 123 cooperatively form a "V" shape for providing excellent elasticity. The base portion 121 forms a plurality of protruding portions 1211 on opposite side edges thereof, for strengthening interferential force between the base portion 121 and the housing 10 in the corresponding passageway 103. In addition, the contact 12 comprises a fastening portion 126 extending from the base portion 121 adjacent the solder portion 122, and a contacting pad 1241 extending from a side of the elastic portion 124 adjacent the guiding portion 125. The fastening portion 126 is used for preventing the contact 12 from rotating in the corresponding passageway 103. The contacting pad 1241 is used to electrically connect with the LGA IC module (not shown). Moreover, an area of the contacting pad 1241 is less than an area of the solder portion 122, and a vertical projection of the contacting pad 1241 on the solder portion 122 is entirely within the solder portion 122.

The passageway 103 of the housing 10 has a centrosymmetric configuration. The passageway 103 is bounded by two centrosymmetric first walls 1031, two centrosymmetric second walls 1032 and two centrosymmetric third walls 1033, which cooperatively form respective steps therebetween. One first wall 1031 and a third wall 1033 opposite from the first wall 1031 define a first cavity 1034 therebetween. The two second walls are opposite from each other, and define a second cavity 1035 therebetween. The other third wall 1033 and the other first wall 1031 define a third cavity 1036 therebetween. In addition, the passageway 103 is bounded by two centrosymmetric steps 1038, and comprises two centrosymmetric guiding slots 1037 therein.

Figure 4:
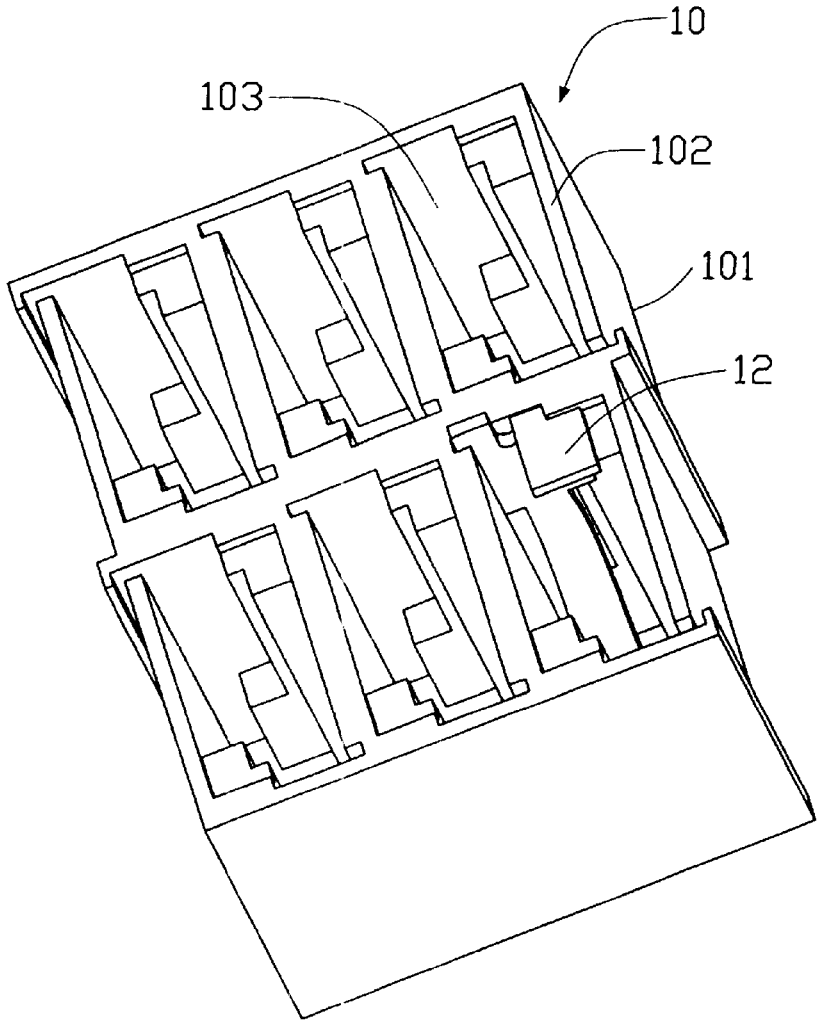
FIG. 4 is similar to FIG. 3, but showing the housing inverted.
Figure 5:
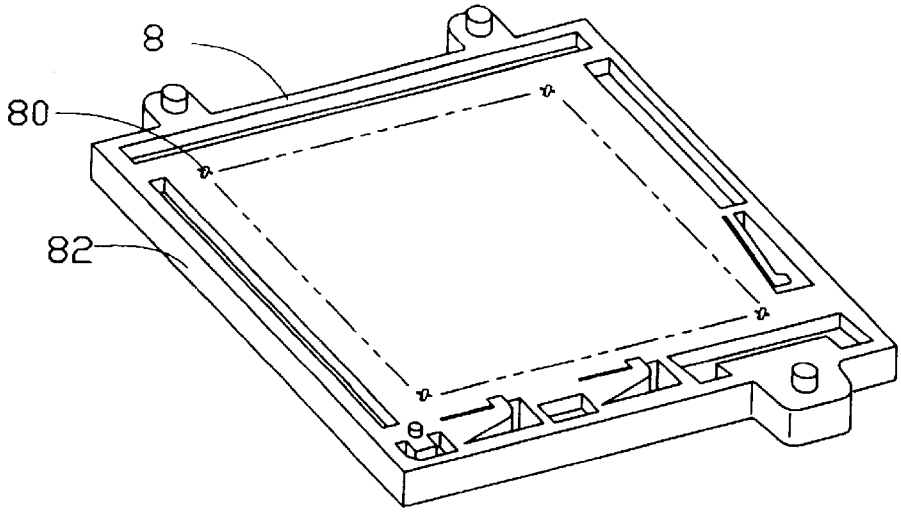
FIG. 5 (PRIOR ART)
FIG. 5 is a simplified, isometric view of a conventional electrical connector.
Figure 6:
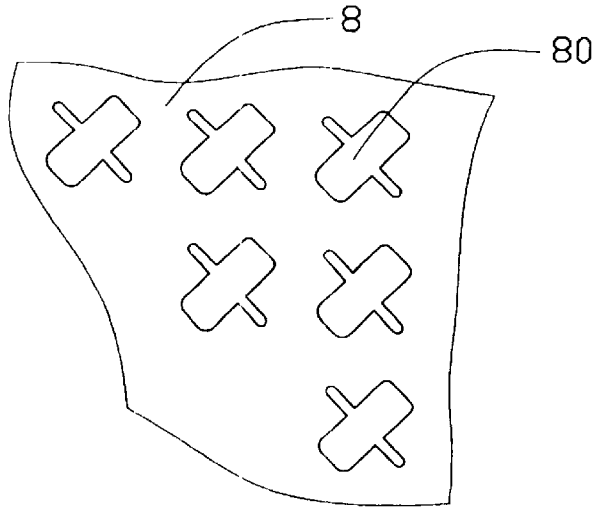
FIG. 6 (PRIOR ART)
FIG. 6 is an enlarged, top elevation view of part of the electrical connector of FIG. 5.

Referring to FIGS. 2~4, two contacts 12 are installed into each passageway 103 from the second surface 102. The base portion 121 of one contact 12 is interferentially received in the first cavity 1034, and the base portion 121 of the other contact 12 is interferentially received in the third cavity

1036. The fastening portions 126 of the two contacts 12 are interferentially received in the two guiding slots 1037 respectively. The elastic portions 124 protrude slightly out beyond the first surface 101. Corresponding protruding portions 1211 of the two contacts 12 interferentially engage with the steps 1038 respectively, for restricting movement of the contacts 12 in the passageway 103. The two solder portions 122 of the contacts 12 are received in the second cavity 1035, and are aligned with each other. Thus, a space between the two contacts 12 received in one passageway 103 is less than a corresponding space in a passageway of a conventional housing. The present arrangement enables a higher density of contacts 12 for a given size of the housing 10. Moreover, because the two contacts 12 are partially interlaced in the passageway 103, the elastic portions 124 of the contacts 12 can be configured relatively long, to provide enhanced elasticity.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector used for electrically connecting a land grid array integrated circuit (IC) module to a printed circuit board (PCB) comprising:

an insulative housing defining a first surface adapted to carry the IC module, a second surface adapted to connect with a substrate of the PCB, and a plurality of passageways communicating the first and the second surfaces;

a plurality of contacts interferentially received in the passageways, each passageway receiving two contacts therein;

wherein each Passageway receives two contacts of same structure therein and the two contacts are opposite to each other;

wherein the Passageway is centrosymmetric and is bounded by two first walls, two second walls and two third walls;

wherein the first wall is opposite from the third wall and the two second walls align with each other;

wherein one first wall and a third wall opposite from the first wall define a first cavity therebetween, the two second walls define a second cavity therebetween and the other third wall and the other first wall define a third cavity;

wherein the passageway further is bounded by two centrosymmetric steps therein; and wherein the passageway further comprises two centrosymmetric guiding slots therein.

2. The electrical connector as described in claim 1, wherein the contact comprises a base portion interferentially received in the passageway, a solder portion extending from the base portion, a bending portion extending from the base portion far away from the solder portion and an elastic portion extending from the distal end of the bending portion.

3. The electrical connector as described in claim 2, wherein the elastic portion and the bending portion cooperatively form a V-like shape for providing high elasticity.

4. The electrical connector as described in claim 3, wherein the contact further defines a guiding portion extending from the elastic portion toward the solder portion.

5. The electrical connector as described in claim 4, wherein the elastic portion defines a contacting pad adjacent the guiding portion.

6. The electrical connector as described in claim 5, wherein a vertical projection area of the contacting pad on the solder portion is entirely within the solder portion and the projecting area is less than an area of the solder portion.

7. The electrical connector as described in claim 6, wherein the two solder portions of the contacts in same passageway are received in the second cavity and are aligned with each other.

8. An electrical connector comprising:

an insulative housing defining a plurality of passageways in rows and columns;

plural pairs of contacts respectively disposed in the corresponding passageways, each pair of contacts including two similar contacts roughly symmetrically arranged with each other along a diagonal direction in the corresponding passageway;

wherein each contact of said each pair includes a resilient bending portion extending along a lengthwise direction, and a contacting pad extending from the resilient bending Portion above a top face of the housing and in a lateral direction perpendicular to said lengthwise direction;

wherein the contacting pads of each pair of contacts extend toward each other so as to be generally at least partially align with each other in said lengthwise direction; and wherein the contacting pads of said pair of contacts are respectively located at two opposite ends of the corresponding passageway in said lengthwise direction.

* * * * *